US007016627B2

(12) United States Patent
Shibuya et al.

(10) Patent No.: US 7,016,627 B2
(45) Date of Patent: Mar. 21, 2006

(54) IMAGE FORMING APPARATUS HAVING IMAGE BEARING MEMBER AND MOVABLE OTHER MEMBER

(75) Inventors: Takashi Shibuya, Shizuoka-ken (JP); Jun Shao, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/668,227

(22) Filed: Sep. 24, 2003

(65) Prior Publication Data

US 2005/0249523 A1 Nov. 10, 2005

(30) Foreign Application Priority Data

Sep. 25, 2002 (JP) ..... 2002-278919

(51) Int. Cl.
*G03G 15/00* (2006.01)

(52) U.S. Cl. ..... 399/167

(58) Field of Classification Search ..... 399/119, 399/302, 308, 167, 312, 313, 71, 299, 300

See application file for complete search history.

(56) References Cited

U.S. PATENT DOCUMENTS

| | | | | |
|---|---|---|---|---|
| 5,532,812 | A * | 7/1996 | Choi et al. | 399/228 |
| 5,579,096 | A * | 11/1996 | Saito et al. | 399/101 |
| 5,587,783 | A * | 12/1996 | Nakamura et al. | 399/301 |
| 5,903,803 | A | 5/1999 | Kawai et al. | 399/116 |
| 6,393,239 | B1 * | 5/2002 | Arcaro et al. | 399/227 |
| 6,519,432 | B1 * | 2/2003 | Matsumoto | 399/167 |
| 6,708,011 | B1 * | 3/2004 | Nomura et al. | 399/110 |
| 2004/0155949 | A1 * | 8/2004 | Masuda | 347/115 |
| 2005/0141920 | A1 * | 6/2005 | Sato et al. | 399/167 |

FOREIGN PATENT DOCUMENTS

| | | | |
|---|---|---|---|
| JP | 2002014545 | A * | 1/2002 |
| JP | 2003029552 | A * | 1/2003 |

* cited by examiner

*Primary Examiner*—Quana Grainger
(74) *Attorney, Agent, or Firm*—Fitzpatrick, Cella, Harper & Scinto

(57) ABSTRACT

The present invention relates to an image forming apparatus comprising a movable image bearing member on which an image is formed; a movable intermediate transfer member, being in contact with said image bearing member, to which the image on said image bearing member is transferred; and a controlling means for starting a drive of said image bearing member after a drive of said intermediate transfer member is started.

10 Claims, 7 Drawing Sheets

(a)

(b)

(c)

IMAGE FORMING APPARATUS HAVING IMAGE BEARING MEMBER AND MOVABLE OTHER MEMBER

BACKGROUND OF THE INVENTION

1. Field of the Invention

This invention relates to an image forming apparatus using an electrophotographic method such as a photocopier and a laser beam printer.

2. Description of Related Art

Various methods have been proposed and produced these days as multicolor image forming apparatuses using the electrophotographic image forming process. For example, exemplified are a multiple transfer method in which images in respective colors are sequentially formed on a transfer material carried on a transfer material carrying member and in which those images are fixed after completion of formation of images in all colors, and a one-time transfer method in which images in respective colors are transferred to an intermediate transfer member once and in which the images in all colors are transferred at a time and fixed to a transfer material after Completion of image formation of all colors done to the intermediate transfer member. Furthermore, there is a method for doing a transfer process to a transfer material or an intermediate transfer material as a one process where image forming units for all the colors are arranged in parallel with respect to the transfer material carrying member or the intermediate transfer member. Those selections are properly chosen with respect to the targeted specifications such as the size, costs, and printing speed of the image forming apparatus.

FIG. 5 is a schematic cross section showing an image forming apparatus most adapted to personal users among the image forming apparatuses described above realizing a compact size. It is structured such that image forming units are surrounding a photosensitive unit as a first image bearing member as a center. Particularly, an intermediate transfer member serving as a second image bearing member realizes a compact apparatus by integrating with the photosensitive unit and accomplishes improvements in usability by reducing the replacement unit number.

As a method for transmitting drive, the drive for units 130 (photosensitive unit, intermediate transfer unit) detachably attached to an image forming apparatus is performed by jointing a coupling member arranged at the respective units with respective coupling members held at the image forming apparatus.

FIG. 6 is an illustration showing a drive shaft of a photosensitive drum and a coupling member C1 formed at a shaft end of a belt-driven roller; (a) is a cross section showing a fitting state of the coupling member C1 and the coupling member C2 of the image forming apparatus when viewed from a lateral side; (b) is a a cross section showing an isolated state of the coupling member C1 and the coupling member C2 of the image forming apparatus when viewed from the lateral side; (c) is a perspective view showing a coupling member C1.

In FIG. 6, the coupling protrusion C1 of the drive shaft (the shaft of a photosensitive drum and a belt drive roller) and the coupling recess C2 of the image forming apparatus are in the fitting state during attachment of the coupling members, and the photosensitive drum 101 and the intermediate transfer belt 105 are driven by transmitting thereto drive applied by a driving means, not shown, of the image forming apparatus.

Where the unit is detached, the coupling member of the image forming apparatus is moved in arrow C direction, and where the coupling members are isolated, the unit is detached. This detaching operation can be done with incorporating, e.g., a mechanism associated with open and closed operation of a door of the image forming apparatus. When the image forming unit is attached, the coupling member of the image forming apparatus is moved in a direction opposite to arrow C in utilizing substantially the same jointly operating mechanism, and the drive force is transmitted to each unit upon fitting of the coupling protrusion and recess according to rotation of the coupling members in association with the beginning of the image forming operation.

Where the photosensitive body unit and the intermediate transfer unit are isolated, the photosensitive drum 101 and the intermediate transfer belt 105 can be kept easily in an isolated state, by providing a mechanism releasing an urging means, not shown, for urging the transfer material 150 toward the intermediate transfer belt 105.

However, where the photosensitive body unit and the intermediate transfer unit are integrated, it is difficult to provide a mechanism keeping the photosensitive drum 101 and the intermediate transfer belt 105 in an isolated state. Even where such a mechanism is provided, the mechanism likely has a complicated structure.

To realize image forming apparatuses for personal use aiming at being made further compact even a little, it is disadvantageous to make compact where the structure is complicated, and such a complicated structure brings increase of the part number, which is very unfavorable in terms of reduction of costs.

Accordingly, the structure, which is simple and can be handled easily by the users, is an image forming apparatus having no isolation mechanism for the photosensitive unit and the intermediate transfer member unit and being in a state that the photosensitive unit is always in contact with the intermediate transfer member unit.

However, with such a structure, the following may occur.

(a) Where a photosensitive body unit detachably attached to an image forming apparatus and an intermediate transfer member unit are attached to an image forming apparatus body, differences among the period that the coupling is completed at respective units may occur. This is due to shapes of the coupling members or coupling phase differences of the coupling members when the coupling members are fitted. Those time differences appear as differences in timings for beginning driving at the respective units. The timing difference in beginning driving caused by the phase difference is of a phase difference of 120 degrees as the maximum value in a case of the triangle coupling members as shown in FIG. 6, and the time difference to nullify the difference becomes the differences in timings to begin driving.

Where the photosensitive body unit first drives and then the intermediate transfer belt begins driving according to timing differences of driving beginning, the drive torque of the photosensitive body unit first beginning the rotation is varied according to the drive of the intermediate transfer belt, thereby generating irregular rotation in the photosensitive body unit. If images are formed already on the photosensitive body unit at that time, it is not favorable because the images are blurred due to the irregular rotation that may occur where the images are already formed on the photosensitive body unit.

(b) As a means for cleaning the remaining toner on the photosensitive drum, it is a general method in which a blade shaped rubber is made in contact with the surface of the photosensitive body to wipe the toners. Where the toner is remaining on the photosensitive body surface, the toner itself becomes a lubricant, so that there is no problem of friction between the cleaning means and the photosensitive body. If no toner is remaining on the photosensitive body surface, wearing on the photosensitive body surface layer proceeds due to friction between the photosensitive body and the cleaning means, thereby reducing the duration of the photosensitive body.

Accordingly, it is unfavorable to operate rotating the photosensitive drum in a state not carrying the toner more than needed.

(c) In a case of a multicolor image forming apparatus, image defects such as color deviations may occur if the image starting positions of the respective colors are not aligned accurately. As a means for aligning the starting positions of the respective colors, a marking for detecting a position is generally formed on the intermediate transfer belt, and an image is formed with reference to the marking.

In the image forming apparatus, a means detectable of the marking position is provided, but the timing starting the image is not yet known until when the marking passes by the detecting means. In order to let the user send a print signal and to print out the material as early as possible, it is desirable to pass the marking portion on the intermediate transfer belt by the detecting means as early as possible. If the marking portion passes with delay, however, the timing starting image formation may be delayed, and images may be outputted with delay.

SUMMARY OF THE INVENTION

It is an object of the invention to provide an image forming apparatus avoiding occurrence of image defects caused by load deviations on the photosensitive body.

It is another object of the invention to provide an image forming apparatus including a movable image bearing member on which an image is formed; a movable intermediate transfer member, being in contact with said image bearing member, to which the image on said image bearing member is transferred, and a controlling means for starting a drive of said image bearing member after a drive of said intermediate transfer member is started.

It is yet another object of the invention to provide an image forming apparatus including a movable image bearing member on which an image is formed; a movable transfer material carrying member for carrying a transfer material, and a controlling means for starting a drive of said image bearing member after a drive of said transfer material body is started, wherein said transfer material carrying member is in contact with said image bearing member, and wherein the image on said image bearing member is transferred to the transfer material on said transfer material carrying member.

Further objects of the invention will be apparent with the following description.

DETAILED DESCRIPTION OF THE PREFERRED EMBODIMENTS

Figure 1:
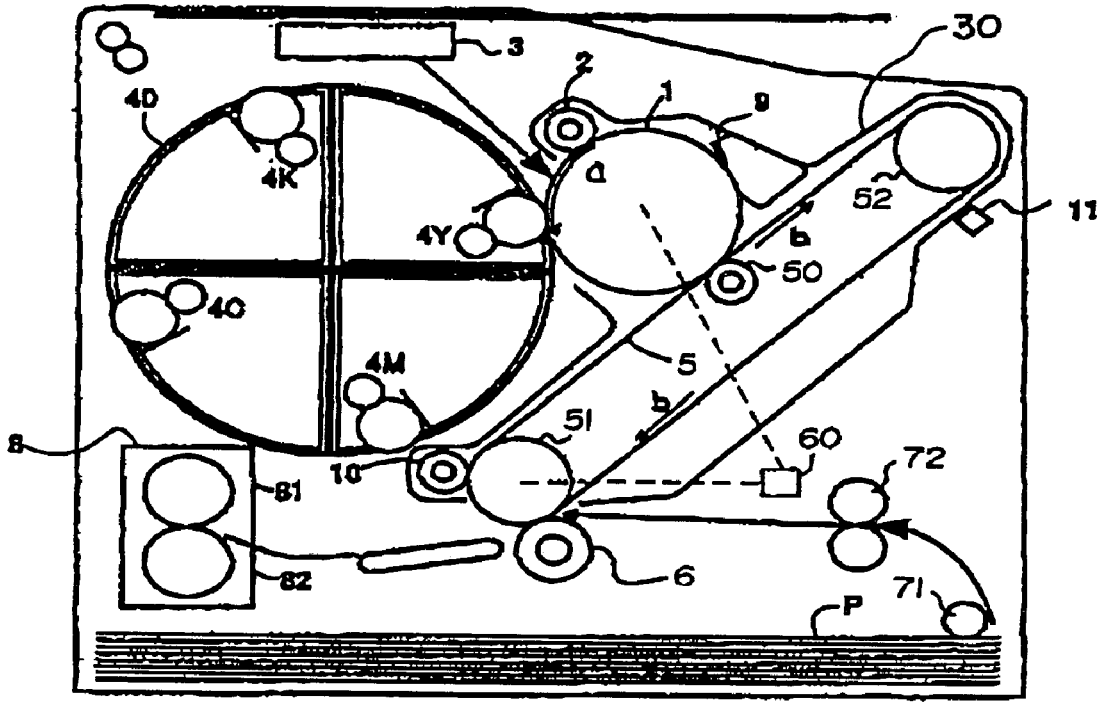
FIG. 1 is a diagram showing an image forming apparatus as an embodiment of the invention.

FIG. 1 is a schematic cross section showing a multicolor image forming apparatus using an electrophotographic process as a basis of the invention.

The multicolor image forming apparatus is a laser beam printer using the electrophotographic process and is a color laser beam printer containing a first image bearing member (photosensitive drum unit), a second image bearing member (belt type intermediate transfer member), and a plurality of developing cartridges (developing cartridges for yellow, magenta, cyan, and black), constituted of a rotatable developing unit 40.

Hereinafter, the multicolor image forming apparatus is described with respect to the structures of respective portions and operations along an image forming step thereof.

[The Whole Structure]

The electrophotographic photosensitive body 1 in a rotary drum type (hereinafter referred to as "photosensitive drum") as the first image bearing member is disposed in the apparatus body. The surface of the photosensitive drum 1 is processed to be charged evenly at a prescribed potential with a charger device 2. The photosensitive drum evenly charged receives laser beam L emitted from an exposure apparatus 3 based on an image signal, and an electrostatic latent image based on the image signal is formed on the photosensitive drum 1. When the electrostatic latent image passes by a developing cartridge 4Y (hereinafter referred to as "developing cartridge") waiting at a position facing with a prescribed gap to the photosensitive drum 1 at a prescribed timing according to the rotation (arrow $\alpha$ direction) of the photosensitive drum 1, bias enabling the toner in a prescribed amount to be developed is applied to the electrostatic latent image, thereby visualizing the electrostatic latent image with a toner image developed by the developing cartridge 4Y. The visualized image on the photosensitive drum 1 is transferred to an intermediate transfer member (hereinafter referred to as "intermediate transfer belt") in an endless belt shape serving as a second image bearing member moving as in contact with the photosensitive drum 1 at a prescribed contacting width at substantially the same speed to the photosensitive drum 1 in the reverse direction to the photosensitive drum 1.

The above process is done in substantially the same way at the developing cartridges 4M, 4C, 4K of other colors, and after the completion of the processes for all colors, not yet fixed toner images made of toners in yellow, cyan, magenta, and black are formed on the intermediate transfer belt 5.

According to the rotational movement of the intermediate transfer belt 5, the not yet fixed toner image on the intermediate transfer belt 5 is conveyed, and a transfer material P is fed by a pickup roller 71 and a feeding roller 72 so as to synchronize with the timing approaching to a second transfer member 6 and is conveyed to a contacting portion between the intermediate transfer belt 5 and the second transfer member 6. When the transfer material passes by the contacting portion, a prescribed bias is applied to the second transfer member 6, and not yet fixed toner image on the intermediate transfer belt 5 is transferred to the transfer material P.

The transfer material P to which the not yet fixed toner image is transferred is conveyed to a fixing device 8, and the image is fixed to the transfer material P upon reception of heat and pressure at the fixing device 8, so that a desired multicolor image is completely formed.

The remaining toner on the photosensitive drum 1 is removed by a cleaning device 9 having a cleaning member 9 in contact with the photosensitive drum 1 after proceeding the step for transfer to the intermediate transfer belt 5, and the process moves on to the subsequent image forming step.

The remaining toner on the intermediate transfer belt 5 is removed by a cleaning device 10 in contact with the intermediate transfer belt 5 after completing a transfer step of the toner image to the transfer material P done by the second transfer member 6, and the process moves on to the subsequent image forming step.

[Image Forming Unit]

Figure 2:
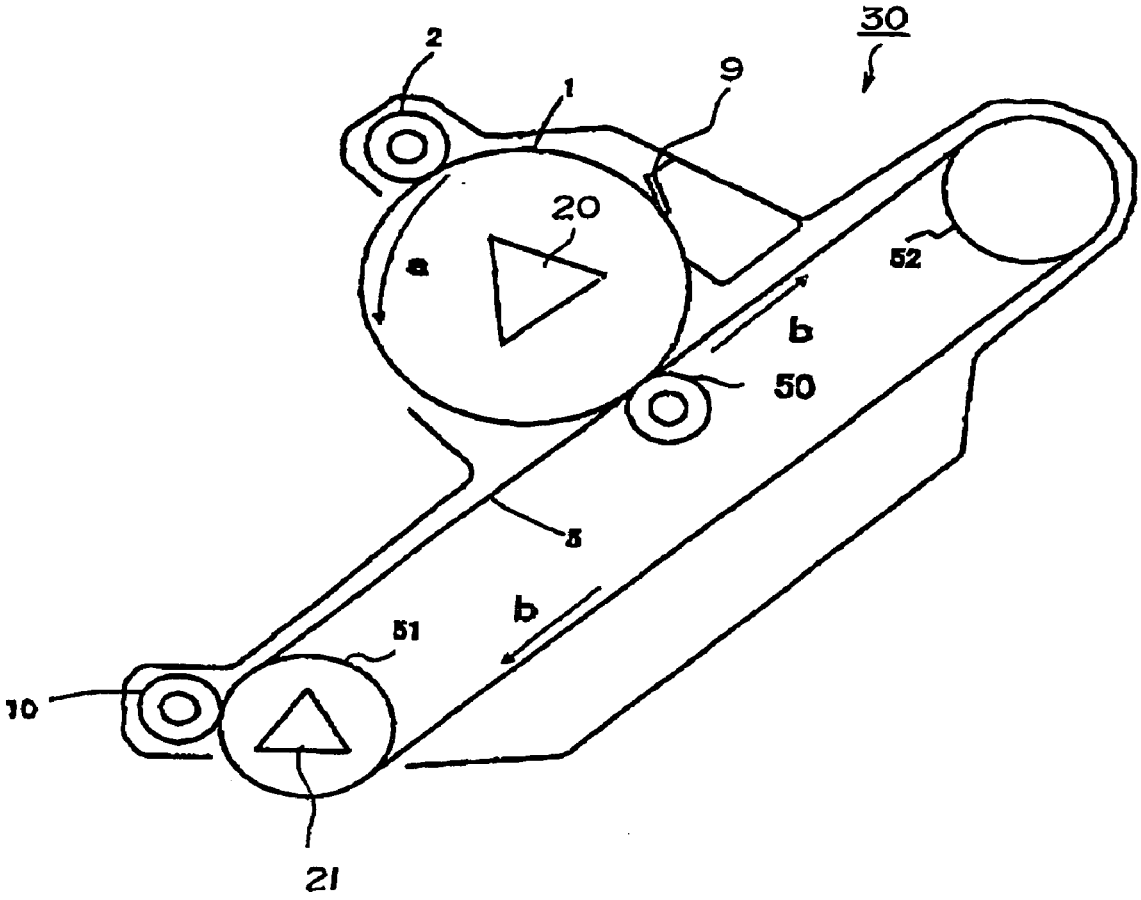
FIG. 2 is a diagram showing a unit in which a photosensitive drum and an intermediate transfer belt are integrated.

FIG. 2 is a cross section showing a unit (hereinafter referred to as "image forming unit") integrating the photosensitive drum 1 and the intermediate transfer belt 5 in the above image forming apparatus. The replacement unit in which conventionally a unit containing the photosensitive drum and a unit containing the intermediate transfer belt 5 are generally independent of each other, is in turn made of an integrated unit in this embodiment, thereby accomplishing improvement in usability.

Figure 4:
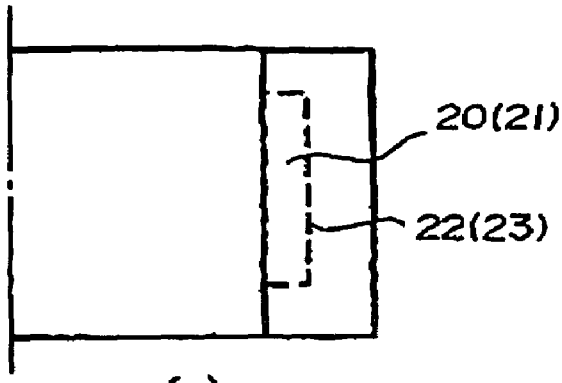
FIG. 4 is a diagram showing a feature of a coupling formed at an end of a drive shaft of the photosensitive drum and an end of a shaft of the belt drive roller.
Figure 4:
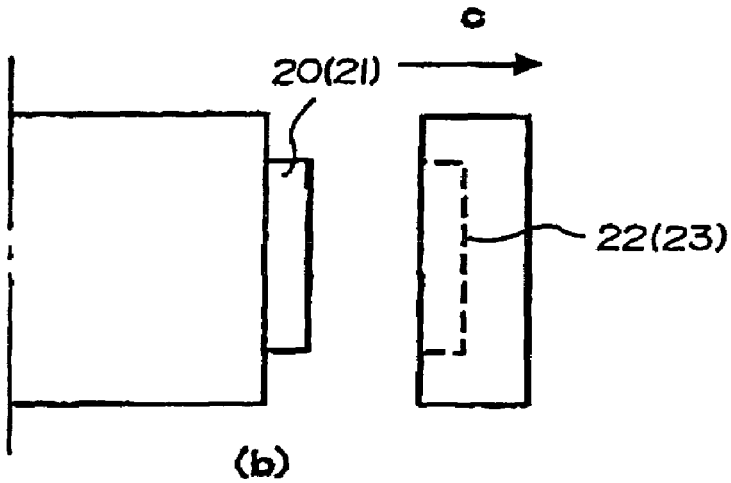
Figure 4:
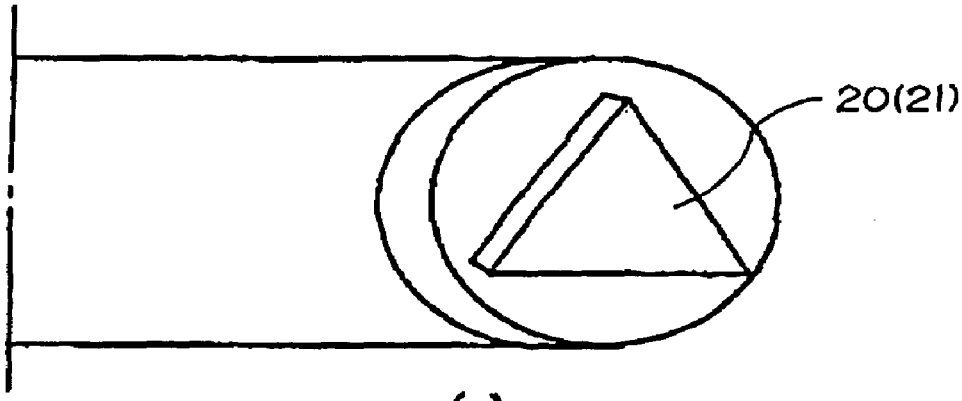
Figure 5:
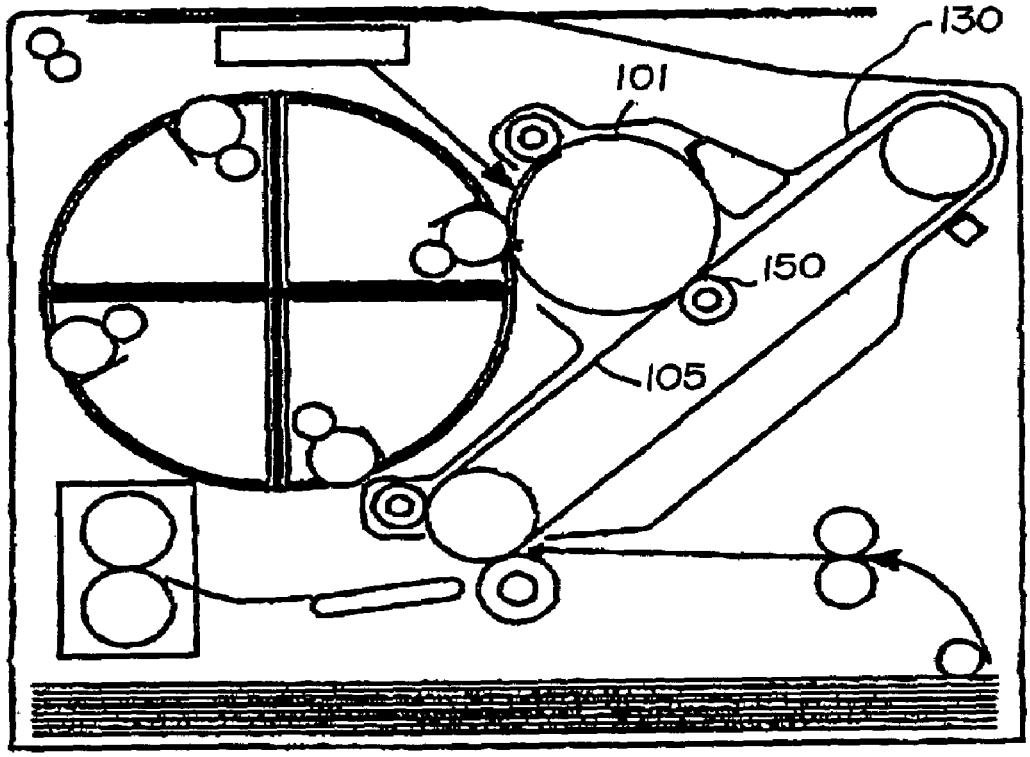
FIG. 5 is a diagram showing an image forming apparatus as a background art of the invention.
Figure 6:
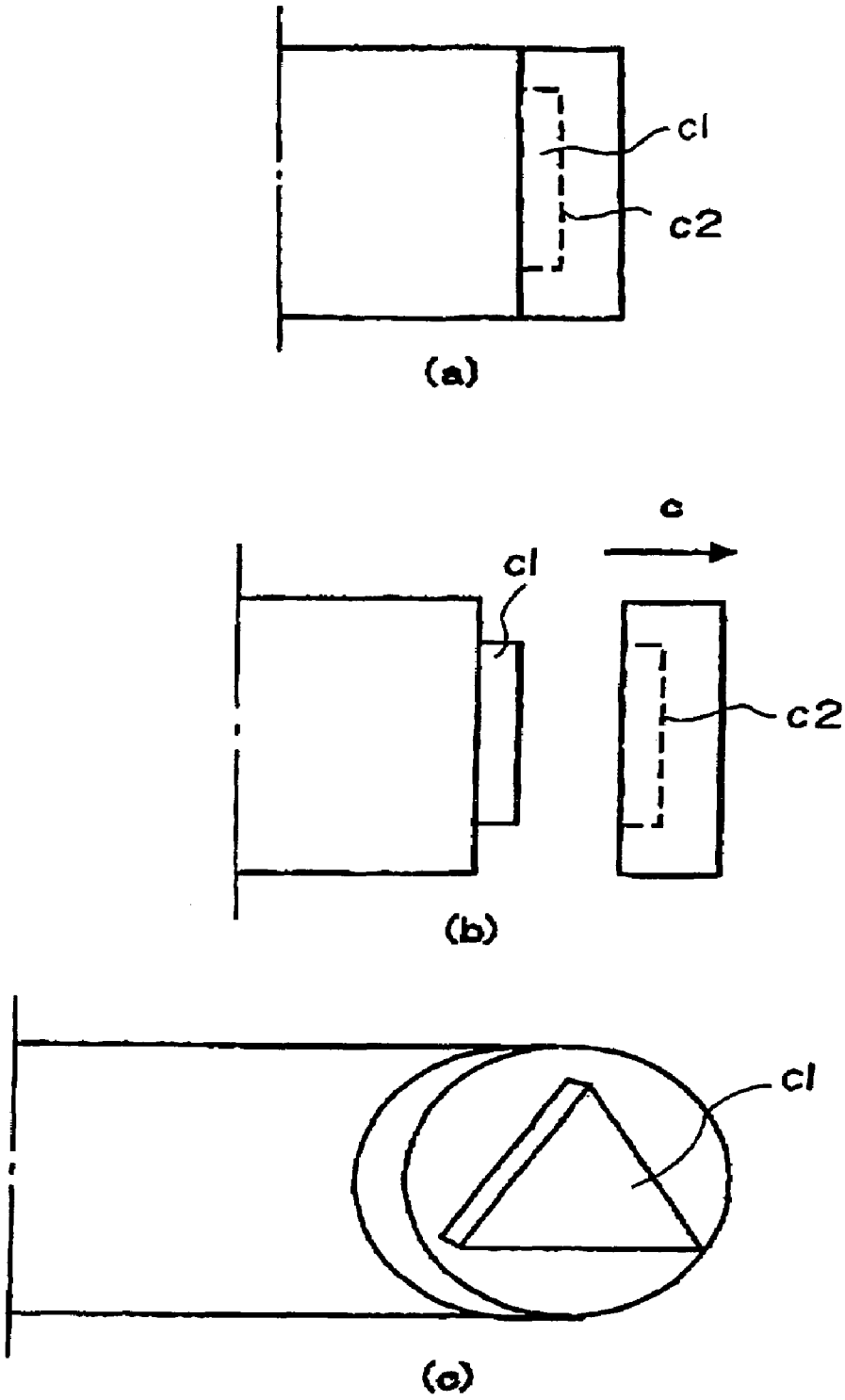
FIG. 6 is a diagram showing a feature of a coupling in FIG. 5.

The image forming unit 30 is a unit detachably attached to an image forming apparatus, and therefore, the photosensitive drum 1 and the drive roller 51 are driven respectively upon transmitting the drive force from the image forming apparatus body via a coupling mechanism as shown in FIG. 4.

That is, a triangle shaped coupling member 20 is attached to an end of the rotary shaft of the photosensitive drum 1, and a triangle shaped coupling member 21 is attached to an end of a rotary shaft of the drive roller 51 serving as a tension roller. If the image forming unit 30 is attached to the apparatus body, those coupling members 20, 21 are fitted to coupling members (a coupling member 22 for photosensitive drum, and a coupling member for drive roller 23), and the drive force is transmittable from a drive source, not shown, thereby rotatively driving the photosensitive drum 1 and the intermediate transfer belt 5.

The intermediate transfer belt 5 is a resin belt made of a PVDF (poly vinylidene fluoride) resin as a base material having a thickness of 80 microns, a peripheral length of 440 mm, and a width of 245 mm. This belt is adjusted to have $10^8$ to $10^{10}$ Ω·cm by dispersing and molding a conductive agent as an electric resistance adjusting agent.

The first transfer member 50 is disposed at a position facing to a photosensitive drum 1 via the intermediate transfer belt 5. The first transfer member 50 is a roller for applying a necessary transfer bias for transferring the toner image on the photosensitive drum 1 to the intermediate transfer belt, and is kept in a state contacting to the photosensitive drum 1 normally sandwiching the intermediate transfer belt 5 in the image forming apparatus.

The first transfer member 50 does not have drive force and is driven to rotate with respect to the belt according to the rotation of the intermediate transfer belt 5. The first transfer member 50 is in a roller shape made of a foamed elastic body (core metal diameter of 6 mm) having an outer diameter of 14 mm and an adjusted value resistance of $10^5$ to $10^9$ Ω·cm, and receives 0.2 to 4 kV bias when the toner image on the photosensitive drum 1 is transferred onto the intermediate transfer belt 5. The hardness of the elastic layer is ASKER-C(JIS-A) 20 to 40 degrees.

The intermediate transfer belt 5 is suspended in application of prescribed tensions from tension rollers 51, 52. The tension roller 51 also has a function as a drive roller for driving the intermediate transfer belt 5 in arrow b direction.

[Second Transfer Member]

The second transfer member 6 is located in a state isolated from the intermediate transfer belt 5 during the normal image forming operation, and comes in contact with the intermediate transfer belt 5 by an isolation mechanism, not shown, in synchronous with the timing that the transfer material P is conveyed to the second transfer member 6. After completion of the transfer step to the transfer material P, the second transfer member 6 is isolated from the intermediate transfer belt 5.

The second transfer member 6 is in a roller shape made of a foamed elastic body (core metal diameter of 6 mm) having an outer diameter of 18 mm and an adjusted value resistance of $10^5$ to $10^9$ Ω·cm, and receives 0.2 to 4 kV bias when the toner image on the intermediate transfer belt 5 is transferred onto the transfer material P. The hardness of the elastic layer is ASKER-C(JIS-A) 20 to 40 degrees.

[Fixing Device]

The fixing device 8 is constituted of a pair of rollers having an outer diameter of 40 mm made of silicone rubber, which is controlled to be heated at 180° C. by heaters, not shown, disposed inside the rollers.

In the image forming apparatus attached with the above image forming unit, images are verified where the drive starting timings are shifted between the photosensitive drum 1 and the intermediate transfer belt 5.

[Drive Starting Timing of the Photosensitive Drum and the Intermediate Transfer Belt]

In this embodiment, a controlling means 60 controls the drive of the photosensitive drum 1 and the intermediate transfer belt 5 (drive roller 51) so that the drive of the intermediate transfer belt 5 starts before the start of the drive of the photosensitive drum 1 where drive force is transmitted to the photosensitive drum 1 and the intermediate transfer belt 5 for image formation.

The deviation of the drive start timing between the photosensitive drum 1 and the intermediate transfer belt 5 is made such that the drive start timing of the intermediate transfer belt 5 is earlier than the drive start timing of the photosensitive drum 1 for image formation by deviating the speed of transmission to the respective coupling members 20, 21 from the drive source in the respective drive transmission systems, not shown, arranged in the apparatus body.

Because the coupling members 20, 21 described above are in the triangle shape, there is a phase difference of maximum 120 degrees from the rotation start to the fitting completion of the coupling at the apparatus body where the members are not completely fitted to the coupling members 22, 23 of the apparatus body. Therefore, it is desirable to design the drive transmission to the coupling member 21 of the intermediate transfer belt 5 is started earlier, by the time difference to cancel the phase difference or more, than the drive transmission to the coupling member 20 of the photosensitive drum 1. That is, the drive force is transmitted to the photosensitive drum 1 and the intermediate transfer belt 5 upon coupling to the apparatus body side, and the drive force transmission start for the intermediate transfer belt 5 is done earlier, by the maximum time capable of completion of coupling of the photosensitive drum 1 to the apparatus body side via the coupling members or more, than the drive force transmission start for the photosensitive drum 1.

This operation makes the drive start of the photosensitive drum 1 after the intermediate transfer belt 5 starts driving even where the coupling members 20, 21 are fitted incompletely.

Here, a comparative experiment between a case where the intermediate transfer belt 5 is driven earlier than the photosensitive drum 1 as in this embodiment and conversely a case where the photosensitive drum 1 is driven earlier than the intermediate transfer belt 5 is done as follows.

(A) In a case where the intermediate transfer belt starts driving after drive of the photosensitive drum.

According to drive starting of the photosensitive drum 1, the respective steps (image formation) of the charging processing, the latent image forming processing, and the developing processing are done sequentially. At that time, the drive starting timing of the intermediate transfer belt 5 is set as the following three conditions as (a) after the charging processing starting, (b) after the latent image forming processing starting, and (c) after the developing processing starting.

Under any condition, drive shock during the drive of the intermediate transfer belt 5 appears as, in the case of (a), charging irregularity, in the case of (b), latent image blurred, and in the case of (c), blurred development, and on the image, image defects in horizontal stripes caused by those blurred states occurred.

That is, when the photosensitive drum 1 starts driving, the photosensitive drum 1 receives resistance force from the intermediate transfer belt 5. Much of the resistance force is made of a contact pressure by the first transfer member 50.

However, the intermediate transfer belt 5 rotates with a rotation speed substantially the same as the photosensitive drum 1, so that the load to the photosensitive drum 1 becomes null according to the rotation of the intermediate transfer belt 5. The shock is caused by this load deviation, and it is of a not favorable level as an image quality.

(B) In a case where the photosensitive drum starts driving after drive of the intermediate transfer belt.

Because the intermediate transfer belt 5 is driven first, the load to the photosensitive drum 1 exerted by the intermediate transfer belt 5 is constant where the photosensitive drum 1 is driven; no shock to the photosensitive drum 1 is recognized in accompany with the drive of the intermediate transfer belt 5; and the images are not affected.

It is to be noted that where the drive source of the photosensitive drum unit and the drive source of the intermediate transfer belt are independent of each other, substantially the same effect can be obtained where the respective drive starting timings are thus made different.

As described above, by driving first not the photosensitive drum but the intermediate transfer belt, or namely by starting the drive of the photosensitive drum after controlling means starts drive of the intermediate transfer belt, load deviations with respect to the photosensitive drum during image formation becomes minimum, so that occurrences of the image defects caused by the shock due to the load deviations can be prevented.

In this embodiment, the duration of the photosensitive drum unit can be extended by rendering the drive starting timing of the intermediate transfer belt earlier than that of the photosensitive drum unit.

Figure 3:
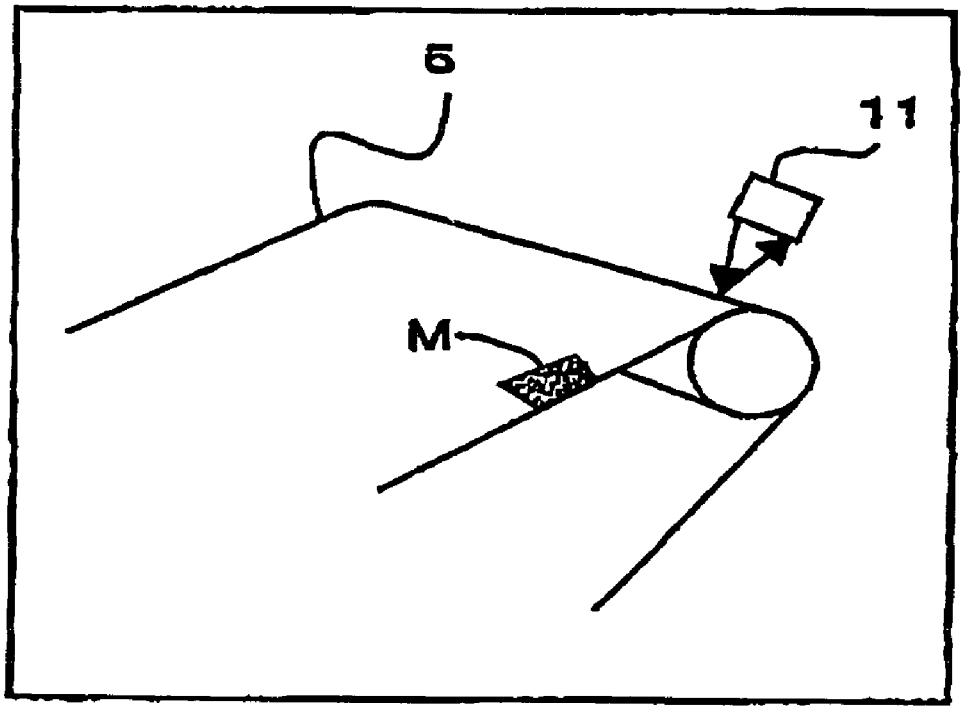
FIG. 3 is a diagram showing a relation of a detection mark and a detection sensor of the intermediate transfer belt.

As a means for detecting writing start timing of the image, an optical detecting means 11 (hereinafter, referred to as "TOP detection sensor") in FIG. 1 is used. FIG. 3 is an illustration showing a relation among the intermediate transfer belt 5, an image writing start position detection mark (hereinafter referred to as "TOP detection mark") formed on the belt, and a TOP detection sensor 11.

The TOP detection mark M has an optical reflectance different from the surface of the intermediate transfer belt 5, and the deviation of the reflection optical amount due to difference in the reflectance is detected with the TOP detection sensor 11 thereby detecting the writing start position. The TOP detection sensor 11 is disposed as facing to the intermediate transfer belt 5 and is disposed at a position in FIG. 1 so as not to disturb detachments and attachments of the image forming unit. By detection of the TOP detection mark M with the TOP detection sensor 11, the position of the intermediate transfer belt 5 is detected.

Where the TOP detection mark M is thus structured on the intermediate transfer belt 5, the start of the image formation is done after the TOP detection sensor 11 detects the passage of the TOP detection mark M. Then, the image forming step constituted of the charging processing, the latent image step, and the developing step with respect to the photosensitive drum 1, is performed.

To realize this, where the photosensitive drum 1 rotates earlier than the intermediate transfer belt 5, the photosensitive drum 1 continuously rotates until the TOP detection sensor 11 detects the TOP detection mark M.

In general, the cleaning means 9 of the photosensitive drum 1 is a rubber blade, and where the toner is remaining on the photosensitive drum 1, wearing on the surface layer of the photosensitive drum 1 is reduced because the toner itself functions as a lubricant between the cleaning blade 9 and the photosensitive drum 1 as collecting by wiping the remaining toner.

However, at the start of the image formation as described above, no toner exists on the photosensitive drum 1, so that the load of the cleaning blade 9 to the photosensitive drum 1 becomes larger, and so that the surface layer of the photosensitive drum 1 is further worn out. Accordingly, where the photosensitive drum 1 starts driving first with respect to the intermediate transfer belt 5, wearing of the photosensitive drum 1 proceeds, thereby reducing the duration of the photosensitive drum 1.

To the contrary, where the intermediate transfer belt 5 drives earlier than the photosensitive drum 1, the rotation of the photosensitive drum 1 not carrying the toner can be minimized, and the duration of the photosensitive drum 1, and the duration of the unit containing the photosensitive drum 1 can be extended.

As described above, the intermediate transfer belt drives earlier than the photosensitive drum, wearing of the photosensitive drum surface layer is reduced, and the duration of the image forming unit containing the photosensitive drum can be extended.

The normal flow of image formation starts when a button for "printer" is turned on after selection of the documents and drawings produced at a personal computer by the user. The image forming apparatus side receives an instruction of "printing" and begins the image forming operation.

More specifically, the image forming step, namely steps of the charging process and the latent image formation on the photosensitive drum 1 will be performed after, in the image forming apparatus, the TOP detection sensor 11 detects the TOP detection mark M on the intermediate transfer belt 5 and then the detection of the image writing start position is confirmed The user will be satisfied upon reception of finally output images. Therefore, for the user, it is better to reduce the period from pushing the "printing" button to outputting of images as much as possible.

To render quicker the image forming step even in a small period, it is necessary to reduce the detection time of the TOP detection mark M. Where the intermediate transfer belt 5 rotates earlier than the photosensitive drum 1, the detection of the TOP detection mark M can be made earlier even by a small period of time, thereby avoiding reduction of the duration of the photosensitive drum 1.

The users can avoid getting nervous for waiting for the output image in front of the image forming apparatus because the sought images can be outputted earlier even by a small period of time. Since the duration of the image forming unit containing the photosensitive drum 1 is extended, frequency of the unit replacements can be reduced, and the costs needed for replacements can be reduced.

As described above, because the intermediate transfer belt 5 is driven first with respect to the photosensitive drum 1, and because the image output can be made earlier by rendering earlier the TOP detection time on the intermediate transfer belt 5, the user's satisfaction can be improved such that the user wants to receive output images as early as possible.

In the above embodiments, where the image forming unit 30 is attached to the image forming apparatus body, that is, where the coupling members 20, 21 of the photosensitive drum 1 and the intermediate transfer belt 5 are fitted again to the coupling members of the apparatus body and where the difference in drive start timings occurs according to fitting feelings of the coupling members 20, 21, substantially the same advantages can be obtained by driving first the intermediate transfer belt 5 with respect to the photosensitive drum 1.

Figure 7:
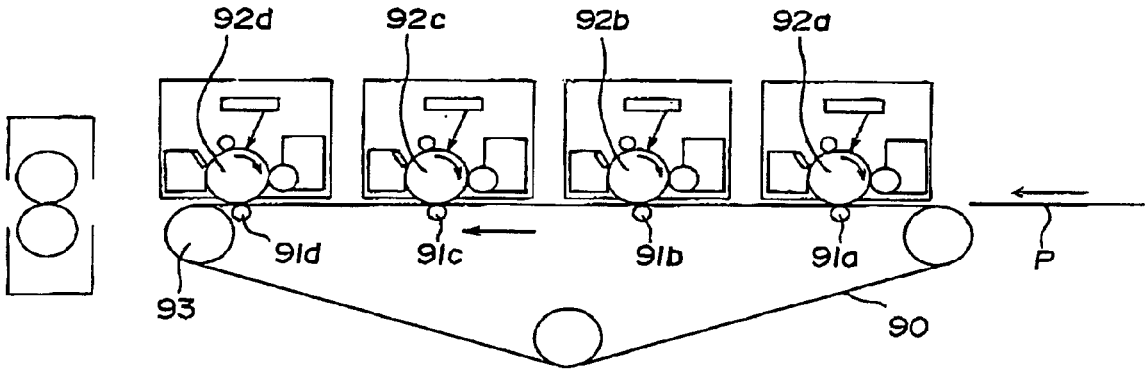
FIG. 7 is a diagram showing an image forming apparatus as another embodiment of the invention.

Although in the respective embodiments described above, in the image forming apparatus of an intermediate transfer method, described are apparatuses obtaining color images in which a toner image is transferred from the photosensitive drum 1 to the intermediate transfer belt 5 and which the toner image is transferred to the transfer material P, it is applicable to an image forming apparatus for forming color images as shown in FIG. 7 in which a transfer material P such as paper is carried by a transfer material of bias to the transfer rollers 91*a*, 91*b*, 91*c*, 91*d* contacting to the belt. The carrying belt 90 as a transfer material carrying member in a manner of electrostatic absorption or the like, in which the belt 90 on which the transfer material is carried is driven to convey the material with a drive roller 93, and in which the toner images are transferred in a multiple manner onto the transfer material from the photosensitive drums 92*a*, 92*b*, 92*c*, 92*d* upon application TOP detection described above is applicable to the transfer material carrying belt.

In such a case, where it is structured such that the drive of the transfer material carrying belt 90 starts before the start of the drive of the photosensitive drums 92*a*, 92*b*, 92*c*, 92*d*, substantially the same advantages can be obtained as the respective embodiments above.

As described above, in this invention, it is structured that the drive of the intermediate transfer member (or transfer material carrying member) starts before the start of the drive of the photosensitive body, so that occurrences of image defects caused by load deviations of the photosensitive body during image formation can be avoided.

Because the rubbing period to the photosensitive body by the cleaning means can be reduced, wearing of the surface layer of the photosensitive body can be suppressed, and the duration of the photosensitive body can be extended.

Furthermore, the detection time of the image writing start position can be made earlier, and the output time of the images can be reduced, so that the user's satisfaction can be improved.

Thus, although the embodiments of the invention are described as the above, the invention is not limited to the above embodiments and can be modified in any way within the scope of technical conceptions of the invention.

What is claimed is:

1. An image forming apparatus comprising:

a movable image bearing member on which an image is formed;

a movable intermediate transfer member, being in contact with said image bearing member, wherein the image on said image bearing member is transferred to said intermediate transfer member;

a controlling device for controlling a drive of said image bearing member and a drive of said intermediate transfer member so as to start the drive of said image bearing member after starting the drive of said intermediate transfer member in a state that said image bearing member and said intermediate transfer member contact each other.

2. The image forming apparatus according to claim 1, wherein an image formation is started on said image bearing member based on movement of said image bearing member.

3. The image forming apparatus according to claim 1, further comprising a cleaning member for contacting and cleaning said image bearing member.

4. The image forming apparatus according to claim 1, further comprising a detecting device for detecting a position of said intermediate transfer member, wherein an image formation is started on said image bearing member based on output from said detecting device.

5. The image forming apparatus according to claim 1, wherein said image bearing member and said intermediate transfer member are contained in the same image forming unit and said unit is attached detachably to an apparatus body.

6. The image forming apparatus according to claim 1, wherein said image bearing member and said intermediate transfer member receive transmission of drive force upon coupling to a side of an apparatus body, and wherein drive force transmission to said intermediate transfer member begins earlier, by a maximum time that said image bearing member can complete a connection to the side of the apparatus body with said coupling or more, than drive force transmission to said image bearing member.

7. An image forming apparatus comprising:

a movable image bearing member on which an image is formed;

a movable transfer material carrying member for carrying a transfer material, wherein said transfer material carrying member is in contact with said image bearing member, and the image on said image bearing member is transferred to the transfer material on said transfer material carrying member; and a controlling device for controlling a drive of said image bearing member and a drive of said transfer material carrying member so as to start the drive of said image bearing member after starting the drive of said transfer material carrying member in a state that said image bearing member and said transfer material carrying member contact each other.

8. The image forming apparatus according to claim 7, wherein an image formation is started on said image bearing member based on movement of said image bearing member.

9. The image forming apparatus according to claim 7, further comprising a cleaning member for contacting and cleaning said image bearing member.

10. The image forming apparatus according to claim 7, further comprising a detecting device for detecting a position of said transfer material carrying member, wherein an image formation is started on said image bearing member based on output from said detecting device.

* * * * *

UNITED STATES PATENT AND TRADEMARK OFFICE

CERTIFICATE OF CORRECTION

PATENT NO. : 7,016,627 B2
APPLICATION NO. : 10/668227
DATED : March 21, 2006
INVENTOR(S) : Takashi Shibuya et al.

It is certified that error appears in the above-identified patent and that said Letters Patent is hereby corrected as shown below:

COLUMN 1
Line 23, "Completion" should read --completion--.
Line 26, "one" should read --single--.

COLUMN 4
Line 40, "α" should read --a--.

COLUMN 6
Line 14, "in synchronous" should read --in synchronicity--.

COLUMN 9
Line 39, "which" should read --in which--.
Line 43, "of bias to the" should be deleted.
Line 44, "transfer rollers 91a, 91b, 91c, 91d contacting to the belt. The" should be deleted.
Line 51, "application" should read --application of bias to the transfer rollers 91a, 91b, 91c, 91d contacting to the belt. The--.

Signed and Sealed this

Thirty-first Day of July, 2007

JON W. DUDAS
*Director of the United States Patent and Trademark Office*